US005782025A

United States Patent [19]

Yoder

[11] Patent Number: 5,782,025

[45] Date of Patent: Jul. 21, 1998

[54] CONCEALED BUCKLE GUN

[76] Inventor: Dale R. Yoder, Box 27-F, Breezewood, Pa. 15533

[21] Appl. No.: 810,522

[22] Filed: Mar. 3, 1997

[51] Int. Cl.[6] ..... F41C 9/02

[52] U.S. Cl. ..... 42/1.09

[58] Field of Search ..... 42/1.09

[56] References Cited

U.S. PATENT DOCUMENTS

| | | | |
|---|---|---|---|
| 278,762 | 5/1883 | Texidor | 2/394 |
| 652,583 | 6/1900 | Baird | 42/71.01 |
| 2,001,405 | 5/1935 | Abbott | 42/2 |
| 3,026,642 | 3/1962 | Ryan | 42/1 |
| 3,267,600 | 8/1966 | Ryan | 42/50 |
| 4,083,138 | 4/1978 | Cash | 42/1 R |
| 4,268,987 | 5/1981 | Cash | 42/1 R |
| 4,377,249 | 3/1983 | Bockoven | 224/163 |
| 4,411,086 | 10/1983 | Christopherson | 42/1 R |
| 4,437,598 | 3/1984 | Hull | 224/163 |
| 4,450,992 | 5/1984 | Casull | 224/163 |
| 5,170,919 | 12/1992 | DeSantis et al. | 224/229 |

*Primary Examiner*—Charles T. Jordan
*Assistant Examiner*—Meena Chelliah
*Attorney, Agent, or Firm*—Henry S. Miller

[57] ABSTRACT

A concealable firearm in the form of a belt buckle with one or more gun barrels and decorative cover plate. Firing pins are cocked from behind the block of steel forming the gun and a slidable trigger plate locks the firing pins in the cocked position and, after a safety pin is removed, releases the spring biased firing pins upon the pull of a lanyard.

9 Claims, 5 Drawing Sheets

CONCEALED BUCKLE GUN

BACKGROUND OF THE INVENTION

1. Field of the Invention

This invention relates generally to the field of fire arms and in particular to fire arms that are concealed and hidden from view.

2. Relevant Prior Art

There are times when law enforcement officers may either be unarmed by choice, as in undercover work for example or in a desperate situation where they are forcibly disarmed. If the situation is grave or unexpected the officer could be aided by a weapon that is actually a belt buckle. There have been a number of proposals to attach a small hand gun to the belt buckle which could be quickly released in the event it was needed. Another method of carrying a handgun is in a pocket that is part of a strap that girdles the waist of the user.

Belt buckles themselves have long been the object of secretion. Frequently used as a storage place for anything from gold dust, to paper money, to drugs to the picture of one's sweetheart.

Typical examples of such prior art devices are found in U.S. Patents, for instance: U.S. Pat. No. 4,377,249 issued Mar. 22, 1983 to Bockoven for a belt buckle gun holder; U.S. Pat. No. 4,437,598 issued Mar. 20, 1984 to Hull for a hidden compartment belt buckle; U.S. Pat. No. 4,450,992 issued May 29, 1984 to Casull for a combination belt buckle-mini-revolver; U.S. Pat. No. Des. 278,762 issued May 14, 1985 to Texidor for the design of a belt buckle with hidden compartments, and U.S. Pat. No. 5,170,919 issued Dec. 15, 1992 to DeSantis et al. for a simulated pouch with an interior concealed holster.

The instant invention is distinguished from the prior art in that it is a primarily a gun and the fact that it also supports trousers is incidental. The buckles of the prior art show a buckle that support a separate hand gun. In use, the gun is removed from the buckle and used in a conventional manner. The invention is never removed from the belt and will fire only in the direction the user is facing or straight ahead. The invention fires four bullets, one time and is meant to be used as a desperation self protection device. It is an unlikely device to use in the commission of a crime since the sight of a weapon is an instrument for instilling fear in the minds of the victim and preferable only used as a last resort. The concealed buckle gun is not seen and has no psychological effect on victims in a crime scenario.

The instant invention as disclosed and claimed herein provides distinct and useful advantages not previously known to the prior art.

SUMMARY OF THE INVENTION

The invention is characterized by its appearance as a common belt buckle, not unlike many buckles seen with Western clothing fashion. The distinctive feature of the gun is the thickness which is substantially more than the ordinary belt buckle. The thickness would only be noticeable on a very slim person, but not on the average male police officer for whom the gun is designed. The invention consists of two blocks of steel in juxtaposition and connected by a hinge pin in one corner and a latch on one side. The steel blocks are rectangular in shape and of the same dimension. The block distal from the wearers body contains the four barrel and chamber assemblies which are threaded into the block. A decorative cover plate is held on the exterior surface of the block by plastic plugs that slide into the four gun barrels. In order to use the gun the cover plate and plugs must be removed. The proximate block is attached to both ends of the belt and secures the buckle in place. The proximate block contains four cylindrical apertures that extend less than the thickness of the block and are positioned directly to the rear of each gun barrel assembly. A small aperture extends from the cylindrical aperture through the remainder of the block and provide access for the firing pin to strike the cartridge in the chamber.

Within each cylinder is a spring biased firing pin that is held in position by an aperture cover plate. Each of the four firing pins includes a collar having a circumferential groove adapted to engage a key hole shaped slot in a sliding trigger bar that translates longitudinally through the block. The firing pin is pointed on one end, the opposed end extends through the aperture cover plate. The extended portion of the pin within the cylinder is surrounded by a spring which drives the pin into the primer on the cartridge causing it to fire. The firing pin extensions are all connected to a posteriorly located I plate. The I plate includes a D ring that will allow the user to draw the firing pins back against the spring and cause the narrow portion of the key hole slots in the trigger bar to engage the circumferential groove in the firing pin. One exterior end of the trigger bar includes a transverse cylinder adapted to receive a safety pin that will prevent translational movement of the trigger bar when the firing pins are in the cocked position. The opposed end of the trigger bar extends beyond the block and is provided as a trigger when pulled out, causing the large portion of the key hole slot to be available to the firing pin collar and allowing it to move with the spring bias and strike the cartridge and firing the gun. To reload, the front block is unlatched and rotated up exposing the spent cartridges which are removed and replaced. After the front block is reloaded and locked in place, the I block is pulled back and the trigger bar restored to its safe condition with the safety pin replaced.

The buckle gun is a last resort personal protection weapon and is not intended to be a rapid fire repeater fire arm of any type.

It is therefore an object of the invention to provide a new and improved concealed buckle gun.

It is another object of the invention to provide a new and improved concealed buckle gun that is easy to hide and safe to use.

It is a further object of the invention to provide a new and improved concealed buckle gun that will provide protection for the wearer.

It is still another object of the invention to provide a new and improved concealed buckle gun that has all the advantages of similar prior art devices and none of the disadvantages.

It is still a further object of the invention to provide a new and improved concealed buckle gun that is of a durable and reliable construction.

It is another object of the invention to provide a new and improved concealed buckle gun that is capable of firing a variety of different caliber cartridges.

These, together with other objects of the invention, along with the various features of novelty which characterize the invention,are pointed out with particularity in the claims annexed to and forming a part of this disclosure. For a better understanding of the invention,its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
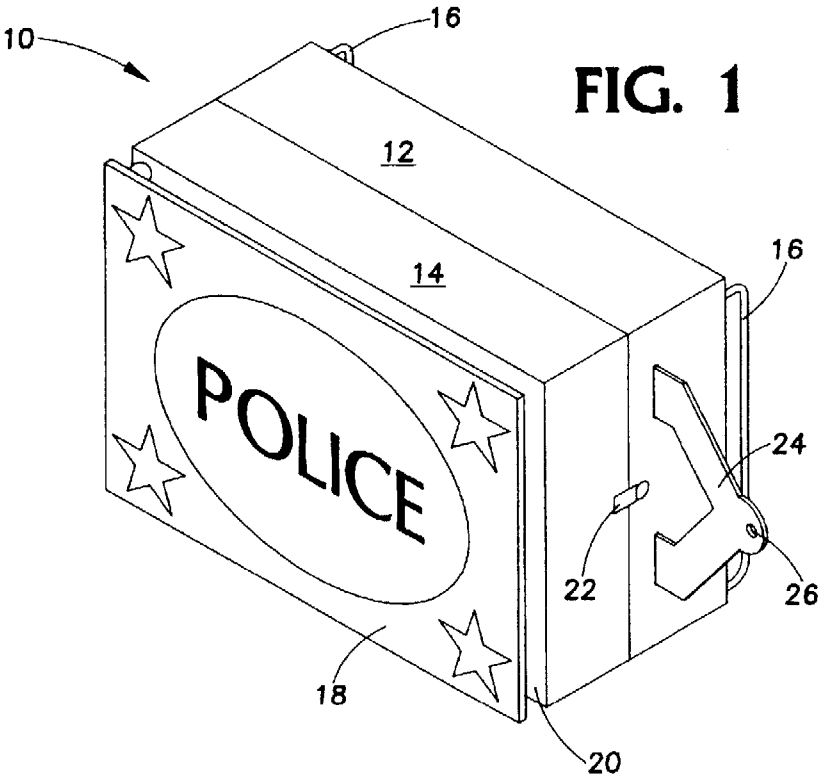
FIG. 1 is a perspective view of the invention.
Figure 2:
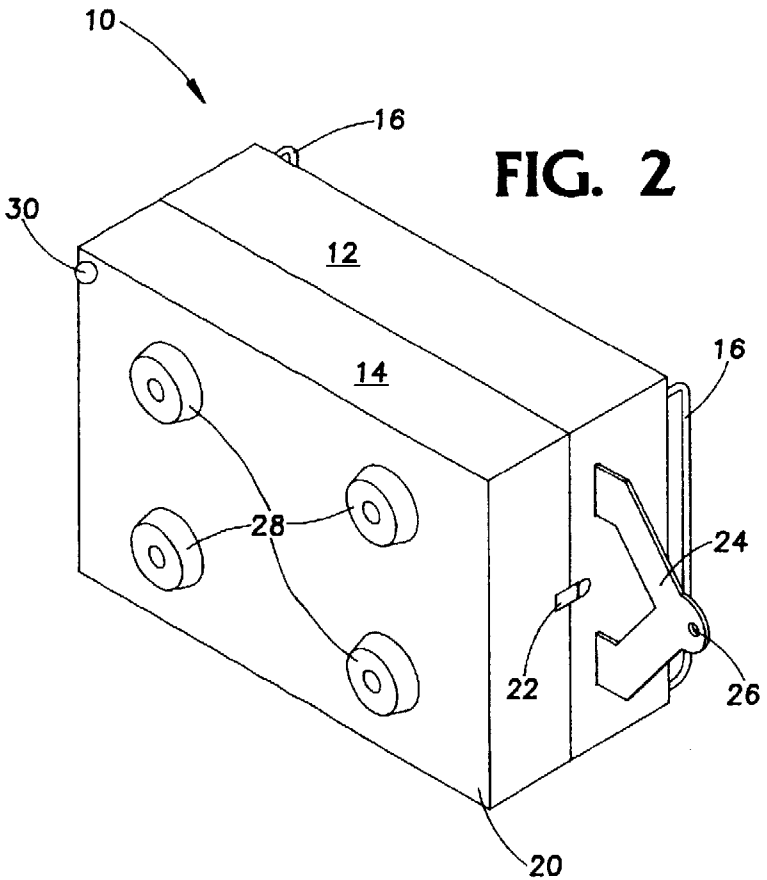
FIG. 2 is a perspective view of the invention with the decorative shield removed.
Figure 3:
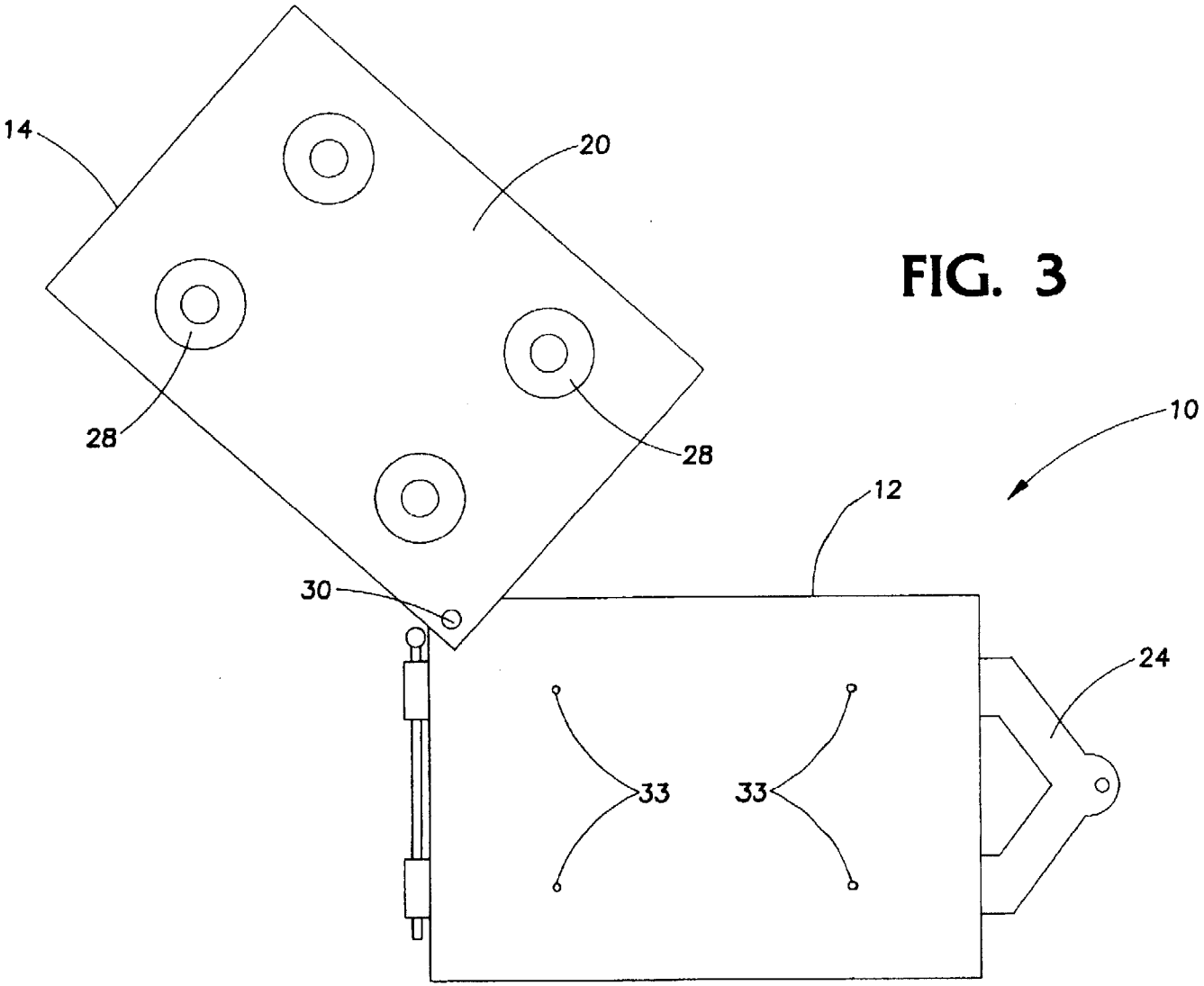
FIG. 3 is a front elevation view of the invention showing the blocks in the open condition.

Referring now to FIGS. 1,2 and 3, the invention is shown generally at 10, and consists of a proximal block 12 and a distal block 14. The preferred material for each block is 302 or 4140 steel. The proximal block 12 includes belt loops 16 at each end for the purpose of connecting a waist girdling belt. A decorative plate 18 is removably attached to the front side 20 of the distal block. The blocks are relatively displaceable and secured in place by a spring latch 22. A longitudinally translatable trigger bar 24 extends from the proximal block and contains a throughgoing aperture 26 for connecting a lanyard for remotely initiating the firing sequence.

FIG. 2 shows four individual barrel assemblies 28 extending from the distal block which expel a projectile in a common and well known manner. The barrel assemblies are threaded into the block and may be all the same caliber or a variety of different calibers dependent, in part, on the nature of the expected threat.

In FIG. 3, the relative displacement is shown between the proximal block 12 and the distal block 14 which hinges about pin 30 which passes through both blocks. Firing pins 32 extend through small apertures 33 in the face of block 12 directly behind the primers of the cartridges in barrel assemblies 28 and cause the firing of the gun.

Figure 4:
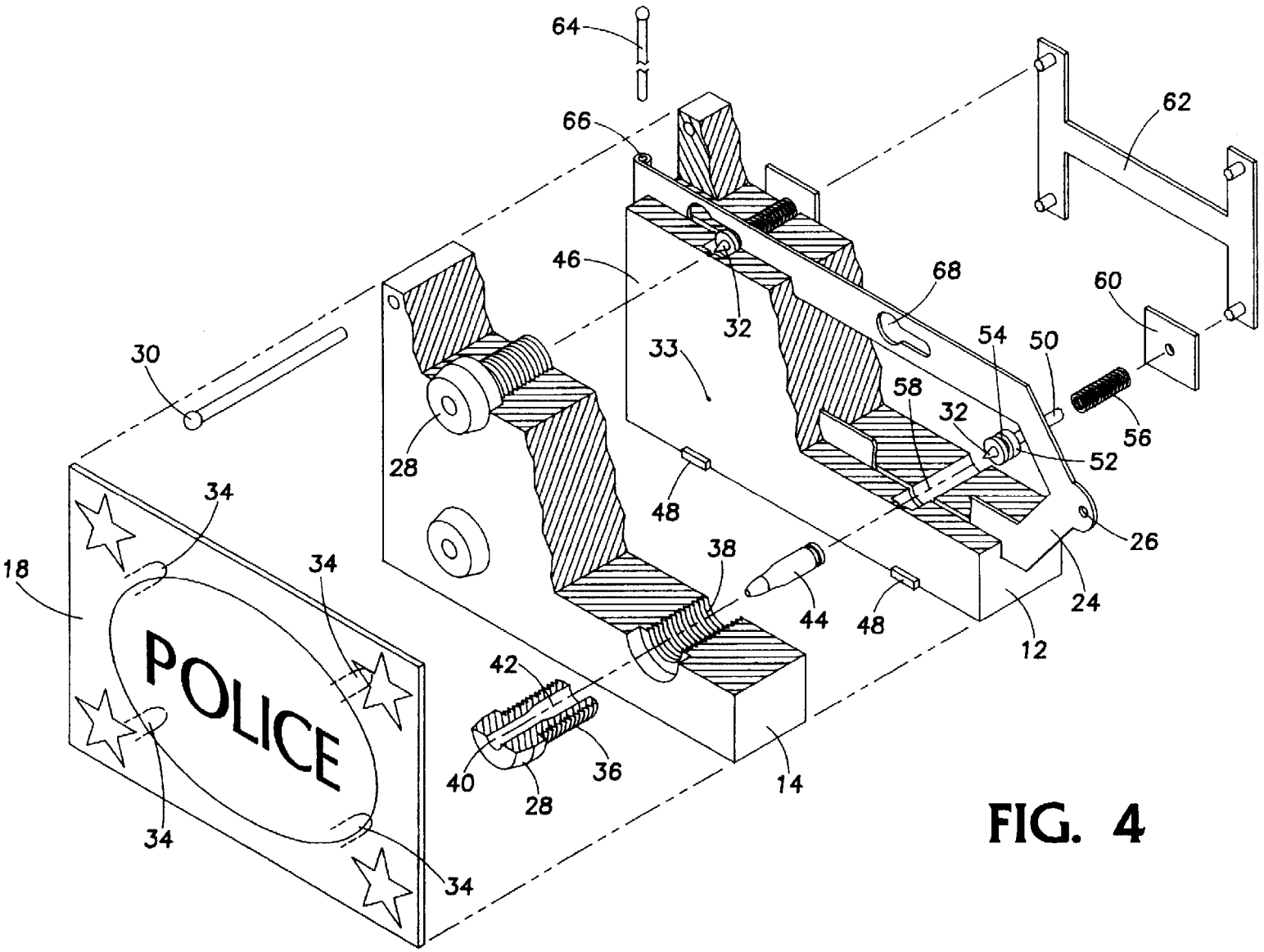
FIG. 4 is an exploded view of the invention.
Figure 5:
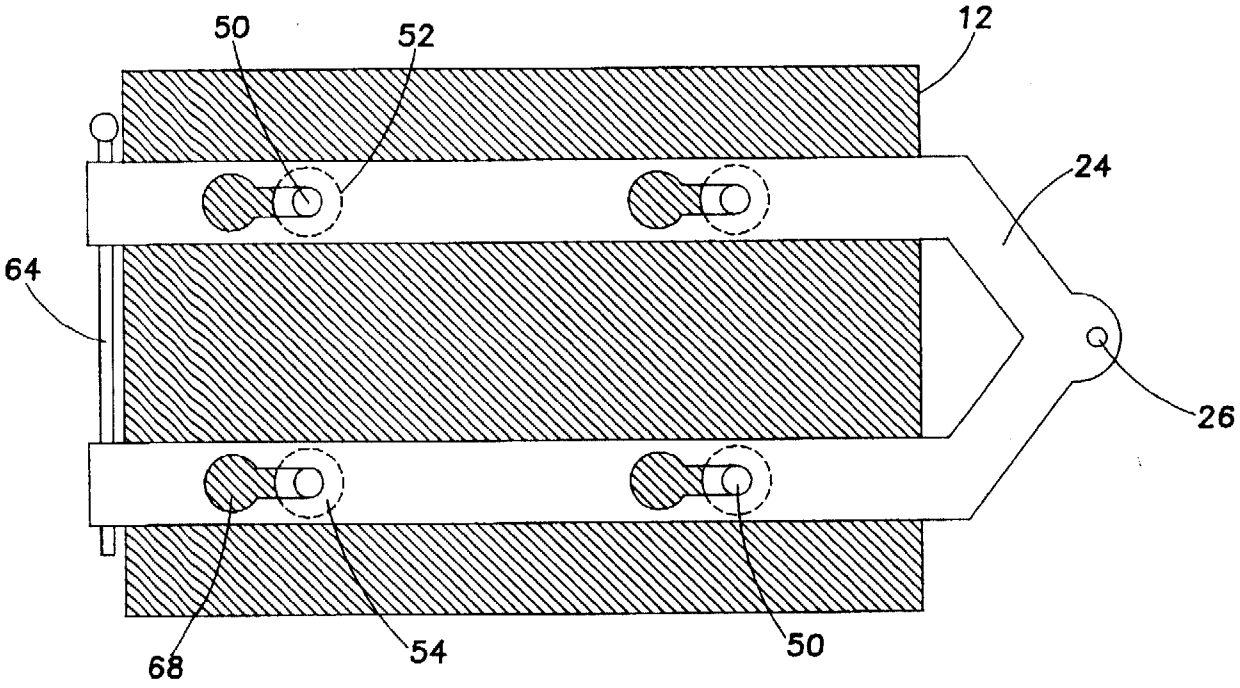
FIG. 5 is a plan view of the trigger bar.

Concerning FIG. 4, the exploded view of the invention shows the decorative plate 18 with plastic plugs 34 that form a sliding fit with the barrel assembly 28 and allows the plate to be installed or removed by merely applying the appropriate force to the plate 18. Each barrel assembly 28 has external threads 36 which engage and mate with internal threads 38 in the distal block 14. Each barrel assembly includes a bore 40 with rifling and a chamber 42 for receiving the cartridge 44. The chamber is loaded when the distal block is positioned as shown in FIG. 3.

The front face 46 of proximal block 12 includes two tabs 48 which extend from the block and limit the movement of distal block 14 and insures proper alignment between the firing pins 32 and the primer of cartridge 44. Each firing pin 32 includes an extension 50 and a collar 52 having a circumferential groove 54. The firing pin assembly consists of, the firing pin 32, collar 52, extension 50 and spring 56. The assembly fits into a cylinder aperture 58 in the proximal block 12. An aperture plate 60 secures the assembly within the block and allows the extension to reach beyond the block where it is attached to an external I plate 62. Plate 60 is appropriately affixed to the back surface of block 12 by suitable and conventional fastening means.

Trigger plate 24 is translatably mounted in the block 12. Movement is restricted by safety pin 64 which engages the rolled end portion 66 of the trigger bar and prevents movement by interference with the block body 12. The trigger bar 24 contains a key hole shaped slot 68 for each firing pin and barrel assembly. The large area of the key hole allows the firing pin and collar to pass through. The narrow portion of the key hole engages the groove in the collar and secures the firing pin against the bias of spring 56. When the trigger bar is moved, allowing the firing pin to pass through the large area of the key hole, the firing pin is driven by the bias of the spring and it moves forward, striking the primer of the cartridge and causing the gun to fire. The firing pin is withdrawn to its cocked-safe position by the user grasping the I plate 62 and retracting it and sliding the trigger bar back into the block 12 and replacing the safety pin 64.

The cartridges are removed and replaced when the distal block is unlatched and rotated as shown in FIG. 3.

Figure 6:
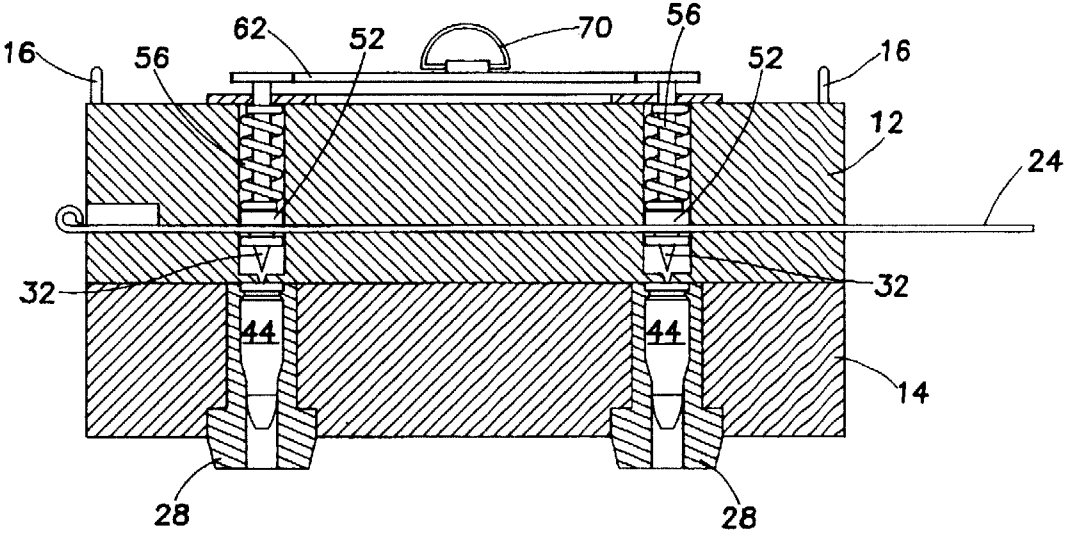
FIG. 6 is a cross sectional view of the invention with the firing pins in the cocked condition.
Figure 7:
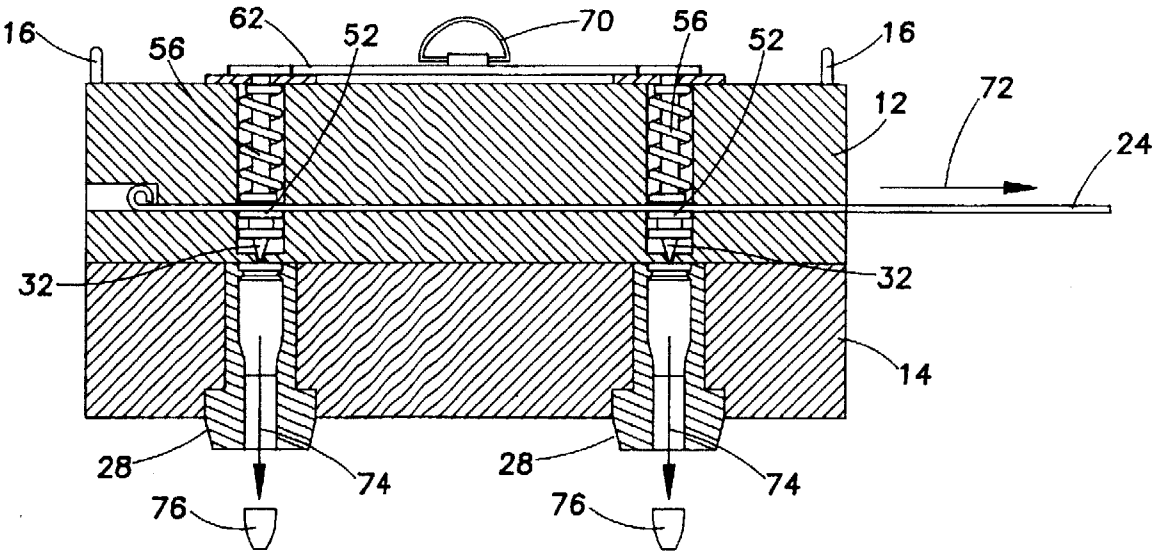
FIG. 7 is a cross sectional view of the invention with the firing pins in the firing condition.

FIGS. 6 and 7, show barrel assembly and fire pin assembly in the cocked, safe condition and the fire condition respectively. The D ring 70 is hinge mounted to the I plate and allows the user to conveniently withdraw the firing pin assemblies in order to cock the gun. FIG. 7 uses directional arrow 72 to show the direction of movement of the trigger plate 24 and arrows 74 show the direction of travel of the projectile 76 when the gun is fired.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A concealable personal protection buckle gun comprising; a first block of steel having dimensions of length, width and thickness;

a second block of steel having dimensions of length, width and thickness;

means for securing the first block of steel and the second block of steel in a translatable relation;

a plurality of gun barrel and receiver assembly means positioned in the second block of steel;

a plurality of firing pin assembly means positioned in the second block in a position to cooperatively function with said gun barrel and receiver means;

means for moving the firing pin assembly means to a cocked position;

means for restraining the firing pin assembly means in a cocked position, and trigger means for releasing the firing pin assemblies whereby a cartridge in the receiver of any barrel and receiver means will discharge causing the projectile attached to the cartridge to escape through the barrel.

2. A concealable personal protection buckle gun according to claim 1 wherein: the means for securing the first block of steel and the second block of steel in a translatable relation comprises a pin passing through one corner of each block about which one said block rotates relative to the other said block, and a releasable spring latch on a side opposite to the pin, for preventing relative rotation between the blocks.

3. A concealable personal protection buckle gun according to claim 2 wherein: the firing pin assembly means includes a plurality of firing pins; spring bias means surrounding each firing pin causing said firing pin to enter the receiver assembly; means attached to one end of the firing pins to cooperatively withdraw said pins from the receiver assembly against the bias of the springs, and means for releasably restraining the firing pins away from the receiver assembly in a cocked condition.

4. A concealable personal protection buckle gun according to claim 3 wherein: each firing pin is cylindrically shaped, having a taper at one end and a collar including a circumferential groove positioned proximate the tapered end.

5. A concealable personal protection buckle gun according to claim 4 wherein: the means for releasable restraining the firing pins is a sliding trigger plate, positioned in a plane parallel to the face of the steel block including, an aperture at one end extending beyond the second block for attaching a firing lanyard, and a safety pin retaining means at the opposed end for preventing the accidental translation of the trigger plate.

6. A concealable personal protection buckle gun according to claim 5 wherein: the trigger plate includes a keyhole shaped aperture for engaging the circumferential groove of the firing pin at its narrow dimension with its largest annular dimension having sufficient size to allow the firing pin and collar to pass through.

7. A concealable personal protection buckle gun according to claim 6 further including: closed loop means outwardly extending from opposed edges of the second block for attaching a belt thereto.

8. A concealable personal protection buckle gun according to claim 7 further including: decorative plate means for covering and concealing the gun barrel means in the first block of steel.

9. A concealable personal protection buckle gun according to claim 8 wherein: the decorative plate means includes plugs of a soft plastic material for engaging the gun barrels and removably securing the decorative plate to the first block of steel.

* * * * *